US007972757B2

(12) United States Patent
Maehata et al.

(10) Patent No.: US 7,972,757 B2
(45) Date of Patent: Jul. 5, 2011

(54) RESIN FOR ELECTROSTATIC-IMAGE-DEVELOPING TONER, ELECTROSTATIC-IMAGE-DEVELOPING TONER, ELECTROSTATIC IMAGE DEVELOPER, METHOD FOR FORMING IMAGE, AND IMAGE-FORMING APPARATUS

(75) Inventors: Hideo Maehata, Kanagawa (JP); Hirotaka Matsuoka, Kanagawa (JP); Fumiaki Mera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 667 days.

(21) Appl. No.: 12/073,254

(22) Filed: Mar. 3, 2008

(65) Prior Publication Data

US 2008/0261133 A1 Oct. 23, 2008

(30) Foreign Application Priority Data

Apr. 20, 2007 (JP) ..... 2007-111185

(51) Int. Cl.
*G03G 9/087* (2006.01)

(52) U.S. Cl. ..... 430/109.3; 525/23; 525/353; 399/121; 399/320

(58) Field of Classification Search ..... 430/109.3; 525/23, 353; 399/121, 320
See application file for complete search history.

(56) References Cited

U.S. PATENT DOCUMENTS

| | | | | |
|---|---|---|---|---|
| 2001/0046636 | A1 | 11/2001 | Daimon et al. | |
| 2002/0072005 | A1 | 6/2002 | Kohtaki et al. | |
| 2007/0275317 | A1* | 11/2007 | Fujimoto et al. | 430/109.4 |

FOREIGN PATENT DOCUMENTS

| | | |
|---|---|---|
| JP | A-49-091231 | 8/1974 |
| JP | A-56-011461 | 2/1981 |
| JP | A-56-040868 | 4/1981 |
| JP | A-62-039879 | 2/1987 |
| JP | A-63-017869 | 4/1988 |
| JP | A-08-334927 | 12/1996 |
| JP | A-2001-042568 | 2/2001 |
| JP | A-2001-305796 | 11/2001 |
| JP | A-2002-91087 | 3/2002 |
| JP | A-2005-266598 | 9/2005 |
| JP | A-2006-169509 | 6/2006 |
| JP | A-2006-323125 | 11/2006 |
| JP | A-2006-323126 | 11/2006 |
| JP | A-2007-057823 | 3/2007 |

OTHER PUBLICATIONS

Silverstein et al. "*Spectrometric Identification of Organic Compounds,* Sixth Edition." 1998. pp. iii, 144-157.
Jan. 19, 2010 Office Action issued in Japanese Patent Application No. 2007-111185 (with translation).

* cited by examiner

*Primary Examiner* — Hoa V Le
(74) *Attorney, Agent, or Firm* — Oliff & Berridge, PLC

(57) ABSTRACT

A resin for an electrostatic-image-developing toner includes a graft polymer, wherein the graft polymer has a polyester structure in the main chain thereof; the graft polymer includes monomer units derived from vinyl monomers in the side chains thereof; and at least a part of the monomer units have a residue of surfactant.

20 Claims, No Drawings

RESIN FOR ELECTROSTATIC-IMAGE-DEVELOPING TONER, ELECTROSTATIC-IMAGE-DEVELOPING TONER, ELECTROSTATIC IMAGE DEVELOPER, METHOD FOR FORMING IMAGE, AND IMAGE-FORMING APPARATUS

CROSS-REFERENCE TO RELATED APPLICATIONS

This application is based on and claims priority under 35 USC 119 from Japanese Patent Application No. 2007-111185 filed on Apr. 20, 2007.

BACKGROUND

1. Technical Field

The present invention relates to a resin for an electrostatic-image-developing toner and, an electrostatic-image-developing toner and, an electrostatic image developer, an image-forming method, and an image-forming apparatus.

2. Related Art

In recent years, in the toner for electrophotography, in addition to conventional requirements for higher image quality and higher productivity, further energy saving manufacture of toners has been required from the viewpoint of the reduction of environmental load.

For satisfying these requirements for the toner for electrophotography, the manufacturing method of the toner has been shifting from conventional methods of melting and kneading resins at a high temperature of 100° C. or more, and then grinding and classifying to the what is called chemical manufacturing method such as an emulsification polymerization flocculation method and a suspension polymerization method of manufacturing a toner at a temperature of 100° C. or less and, further, capable of more precisely controlling powder characteristics of the toner such as the grain size and structure of the toner as compared with the kneading and grinding methods.

In these toners by chemical manufacturing methods, a vinyl polymer that is a polymer from a radically polymerizable vinyl monomer has been used as the resin component. However, in the requirement for further higher image quality and a low energy electrophotographic system in the market, conversion of toner resin components from conventional vinyl polymers to various kinds of polycondensation resins including polyester resins, and use of blended resins of these polycondensation resins with vinyl polymers have been examined.

In this case, in the conversion to polycondensation resins in the toners by chemical manufacturing methods, there remain great problems in the manufacturing methods. In the manufacture of the toners by chemical manufacturing methods, processes of dispersion and emulsification of toner resins in an aqueous medium are essential. In the use of radically polymerizable vinyl polymers in the present situation, dispersion of resin grains in an aqueous medium can be industrially easily manufactured by emulsion polymerization and suspension polymerization methods. Contrary to this, in the case of polycondensation resins such as polyester, it is difficult to use these techniques as principle. Therefore, after resins are once polymerized by block polymerization or solution polymerization, the resins are processed by a high shearing mechanical dispersing method that necessitates a great amount of dispersants and a vast quantity of energy, and a phase inversion emulsifying method of phase inverting the resins with an organic solvent, and then finally removing the organic solvent.

These methods have of course given rise to large problems from the viewpoints of the characteristics of the toner in the manufacture and environmental load.

SUMMARY

According to an aspect of the invention, there is provided a resin for an electrostatic-image-developing toner including a graft polymer, wherein the graft polymer has a polyester structure in the main chain thereof; the graft polymer includes monomer units derived from vinyl monomers in the side chains thereof; and at least a part of the monomer units have a residue of surfactant.

DETAILED DESCRIPTION

Resin for an Electrostatic-Image-Developing Toner

The resin for an electrostatic-image-developing toner according to an aspect of the invention contains a graft polymer in which the main chain has a polyester structure, the side chain has a monomer unit derived from a vinyl monomer, and at least a part of the monomer unit has a residue of surfactant. That is, according to an aspect of the invention, the side chain contains at least a vinyl polymer obtained by polymerizing a vinyl monomer, and the vinyl monomer contains a polymerizable surfactant.

The resin for an electrostatic-image-developing toner according to an aspect of the invention (hereinafter sometimes also referred to as merely "resin" or "binder resin") is used as the binder resin for the electrostatic-image-developing toner.

In the manufacture of toners by chemical manufacturing methods using polyester resins, stabilized emulsification and dispersion are conventionally large problems. When at least one of organic solvent and vinyl monomer is used in a large amount, various environmental problems and characteristic problems arise. Accordingly, it is important to solve the problems of the manufacture in the toners by chemical manufacturing method without sacrificing the characteristics of toners.

In the invention, as a result of earnest examination of the means for stably emulsifying polyester resins in an aqueous medium without using organic solvents and causing no problems on the characteristics, it has been found that excellent characteristics as toners can be obtained by the use of polymerizable surfactants even when vinyl monomers are used, thus the invention has been achieved.

That is, in the invention, in solving the above problems, a polyester resin and a vinyl polymer that is a radical polymer of a vinyl monomer are used as the components of resin. Further, the vinyl polymer contained in the resin is a polymer obtained by polymerization of a polymerizable surfactant having at least a radically polymerizable unsaturated group and a part or the whole of the vinyl polymer is grafted on the main chain of the polyester.

The invention will be described in detail below.

<Polymerizable Vinyl Monomers Having a Residue of Surfactant (Polymerizable Surfactants)>

The resin for an electrostatic-image-developing toner according to an aspect of the invention contains a graft polymer, and the main chain of the graft polymer has a polyester structure, the side chain has a monomer unit derived from a vinyl monomer, and at least a part of the monomer unit has a residue of surfactant. That is, the resin for an electrostatic-image-developing toner according to an aspect of the invention contains a monomer unit derived from a vinyl monomer having a residue of surfactant on the side chain. In the invention, the vinyl monomer having a residue of surfactant is sometimes referred to as "polymerizable surfactant".

In the invention, "polymerizable surfactants" are vinyl monomers having a radically polymerizable unsaturated group in the molecule, and they are amphipathic materials having a hydrophilic group and a lipophilic group. The polymerizable surfactants have functions of capable of emulsifying, dispersing and wetting similarly to ordinary surfactants. In this case, the polymerizable surfactants can be synthesized according to polymerization reaction by mixing a monomer having hydrophilic groups and a monomer having lipophilic groups in a proper mixing ratio and reacting them at the same time. These techniques have been established as soap-free emulsification polymerizations in existing emulsion polymerizations.

In the invention, as the monomer units, it is possible to use both of materials having the function of surfactant, and materials revealing the function of surfactant during the course of polymerization in the relation with the main chains.

The polymerizable surfactants may have chemical structures of revealing the function of surfactant after being (co) polymerized. Even when a polymerizable surfactant as the monomer has hydrophilic groups but the carbon atoms of the lipophilic groups are not sufficiently large in number, if the main chain has sufficient lipophilic groups in the polymer formed as a result of the polymerization of ethylenic unsaturated groups, the polymerizable surfactants can be used in the invention. Sodium styrenesulfonate does not have sufficient lipophilic groups as the monomer, but the copolymers obtained by copolymerization with styrene and butyl acrylate become an amphipathic substance having hydrophilic groups and lipophilic groups.

Incidentally, in the invention, vinyl monomers widely mean monomers having (conjugate) ethylenic unsaturated bonds. Accordingly, the vinyl monomers according to an aspect of the invention include monomers having, e.g., an acryloxy group, a methacryloxy group, a vinyl ether group, an acrylamido group, a methacrylamido group, or a styryl group.

More specifically, as the radically polymerizable unsaturated groups, ethylenic unsaturated groups, e.g., a vinyl group, a propenyl group, a styryl group, a (meth)acryloxy group, a (meth)acrylamido group, a maleic acid ester group, etc., and conjugate ethylenic (polyene) unsaturated groups, e.g., a butadienyl group can be exemplified.

Further, as the hydrophilic groups of the polymerizable surfactants, functional groups such as carboxylic acid (salt), sulfonic acid (salt), sulfuric acid salt, sulfuric acid ester salt, phosphoric acid salt, hydroxyl group, quaternary ammonium salt, pyridinium salt, imidazolium salt, polyoxyalkylene chain, glucoside group, sulfobetaine group, phosphobetaine group, etc., can be exemplified. The kinds of ions are not especially restricted in the invention, and any of anionic, cationic and amphoteric ions can be used.

Of the above hydrophilic groups, sulfonic acid salt, sulfuric acid ester salt, quaternary ammonium salt, and polyoxyethylene chain are preferred, and sulfonic acid salt is more preferred.

Further, as the salts of these hydrophilic groups, alkali metal salts, e.g., sodium, potassium and lithium, alkaline earth metal salts, e.g., magnesium and calcium, and ammonium salt can be exemplified. Alkali metal salts and ammonium salts are preferred, and sodium salts are especially preferably used.

In the invention, of the above polymerizable surfactants, compounds having an ethylenic unsaturated bond and a sulfonic acid group or a salt thereof (referred to as ethylenic unsaturated sulfonic acid (salt) compounds) are preferably used.

As the ethylenic unsaturated sulfonic acid (salt) compounds, sulfonic acids (salts) of aromatic vinyl compounds, sulfonic acids (salts) of aliphatic vinyl compounds, sulfonic acids (salts) of acrylic compounds such as (meth)acrylic acid series, (meth)acrylamide series, (meth)acryl ester series, etc., and sulfonic acids (salts) of polyoxyalkylene compounds containing addition polymers, e.g., ethylene oxide, propylene oxide or butylene oxide as the constituents are preferably used.

As the sulfonic acids (salts) of aromatic vinyl compounds, styrenesulfonic acid (salt), α-methylstyrenesulfonic acid (salt), vinyltoluenesulfonic acid (salt), p-methylstyrene-sulfonic acid (salt), vinylnaphthalenesulfonic acid (salt), etc., are preferably used, and styrenesulfonic acid salt is more preferably used.

As the sulfonic acids (salts) of aliphatic vinyl compounds, vinylsulfonic acid (salt), allylsulfonic acid (salt), 2-methylallylsulfonic acid (salt), vinylsulfo-succinic acid compound, etc., can be exemplified, and vinyl-sulfosuccinic acid compounds are preferably used, and of those, alkenylsulfosuccinic acid salt and alkylallylsulfosuccinic acid salt are more preferably used.

As the sulfonic acids (salts) of (meth)acrylic acid series compounds, (meth)acrylsulfonic acid (salt), 2-sulfo-alkyl ester (meth)acrylic acid, etc., can be exemplified. As the sulfonic acids (salts) of (meth)acrylamide series compounds, 2-(meth)acrylamido-2-methylpropanesulfonic acid (salt), 3-(meth)acrylamidopropane-1-sulfonic acid (salt), 2-(meth) acrylamidoethyl-1-sulfonic acid (salt), 3-(meth)-acrylamido-2-hydroxypropanesulfonic acid (salt), etc., can be exemplified. Further, as the sulfonic acids (salts) of (meth)acryl ester series compounds, 3-(meth)acryloyloxypropane-1-sulfonic acid (salt), 4-(meth)acryloyloxybutane-1-sulfonic acid (salt), 4-(meth)acryloyloxybutane-2-sulfonic acid (salt), 2-(meth) acryloyloxyethyl-1-sulfonic acid (salt), 3-(meth)acryloyloxy-hydroxypropanesulfonic acid (salt), etc., can be exemplified. As the sulfonic acids (salts) of polyoxyalkylene compounds, sulfonic acids (salt) of polyoxyethylene allylglycidyl nonyl phenyl ether and α-sulfo-ω-[2-(1-propenyl)-4-nonylphenoxy]polyoxyethylene (salt) are preferably used. Here, as the salts of these ethylenic unsaturated sulfonic acid (salts), sodium salts and ammonium salts are preferably used.

These polymerizable surfactants can be used alone or two or more surfactants can be used in combination.

The resin for an electrostatic-image-developing toner according to an aspect of the invention may contain about from 0.5 to 10 wt % of the monomer unit having a residue of surfactant. That is, the use amount of the polymerizable reactive surfactant is preferably about from 0.5 to 10 weight parts per 100 weight parts of all the weight of resins including the polyester resin of the main chain, more preferably about from 0.7 to 5 weight parts, and still more preferably about from 1 to 3 weight parts.

When the content of the monomer unit is 0.5 weight parts or more, an electrostatic-image-developing toner having good image characteristics and a fixing property can be obtained when the toner is manufactured with the resin for an electrostatic-image-developing toner according to an aspect of the invention.

In particular, in the manufacture of the toner having a polyester resin as the component of the main chain by chemical manufacturing method, when the content of the monomer unit having a residue of surfactant is 0.5 weight parts or more, the use amounts of surfactants not having a polymerizability and dispersants can be generally lessened in manufacture, and atmospheric dependency in charging characteristics of the electrostatic-image-developing toner can be reduced.

Further, when the content of the monomer unit having a residue of surfactant is 10 weight parts or less, good charging characteristics can be obtained.

The content of the monomer unit having a residue of surfactant in this case is the content by weight parts in all the weight parts (100 weight parts) of the resins of radically polymerizable monomer units having hydrophilic groups such as sulfonic acid salt, acrylic acid salt, etc.

In the invention, a part or the whole of the polymerizable surfactant capable of radical polymerization are grafted on the polyester resin of the main chain.

In this case, the grafted polymerizable surfactant makes it easy to emulsify and disperse the resin in an aqueous medium in the manufacturing process of the toner by chemical manufacturing method. Further, when the constituents of the main chain such as polyester, etc., and other vinyl polymers are blended, it is also possible to control the compatibility of the polyester and the vinyl polymer by the kinds and use amounts of the polymerizable surfactants.

The control of the compatibility of polyester and vinyl polymer also has large influences on the characteristics of the toner, and becomes important factors in toner strength originating in adhesion at interface of the polymer, fixing temperature originating in the melting characteristics of the toner at fixing time, and the uniformity of image quality and image strength originating in the homogeneity of the polymer after fixation.

In the invention, it has been found that these important characteristics as toners are greatly improved by the polymerizable (radically polymerizable) surfactant (the monomer unit having a residue of surfactant) grafted with polyester, thus the invention has been achieved. That is, by using the resin according to an aspect of the invention, not only the problems in the processes of toners by chemical manufacturing method are greatly improved but also various excellent characteristics can be attained in fixation and image quality characteristics as toners.

Polyester resins, in particular, methods for grafting a monomer unit having a residue of surfactant onto the main chain of the polyester resin, and methods of confirmation thereof are described below.

<Grafting Method>

As a grafting method of a vinyl monomer onto a polyester resin, a method of introducing ethylenic unsaturated bond (a radically polymerizable double bond) into a polycondensed resin such as polyester and utilizing it as the initiating point of grafting is generally exemplified.

More specifically describing, by the use of maleic acid or fumaric acid in advance as the polycondensable monomer of polyester, it is possible to introduce an ethylenic unsaturated bond into the skeleton, so that an ethylenic unsaturated bond can be easily introduced into the main chain or terminal of the polyester.

Graft can be easily formed by the polymerization reaction of the polyester resin to which a radically polymerizable ethylenic unsaturated bond is introduced and a polymerizable surfactant capable of radical polymerization with an ordinary radical reaction initiator.

As another method, it has been found that by performing polymerization reaction by blending a radically polymerizable monomer and a polyester resin in the presence of a radical polymerization initiator in high concentration, radical abstraction reaction from the skeleton of the polyester resin is caused and vinyl polymer can be introduced into the polyester main chain by grafting. It is confirmed that this method is effective as the method of introducing a graft chain of vinyl polymer into a polyester resin especially having a bisphenol A skeleton, and the method disclosed, e.g., in JP-B-63-17869 (the term "JP-B" as used herein refers to an "examined Japanese patent publication") can be exemplified.

These known methods can be used in the invention for the introduction of a graft chain into the main chain of polyester, and the methods are not particularly restricted.

In connection with the confirmation method of the introduction of graft chain, various existing organic structure analyzing methods can be used. For example, structural analysis using proton, carbon NMR method, infrared absorbing method such as IR, and gradient GPC method are especially valid as the analyzing techniques of stereoregular structure of a polymer.

For example, in the case where the radically polymerizable ethylenic unsaturated bonds are introduced into polyester skeleton, graft reaction can be confirmed by the reduction and dissipated amount of integration value of double bonding proton in proton NMR, and analysis of integration value of protons newly appeared at the grafting part. As such methods, the methods described in R. Silverstein and F. Webster, Spectrometric Identification of Organic Compounds, Sixth Edition, John Wiley & Sons (1996) can be referred to.

It is necessary that the polymerizable surfactant subjected to graft reaction is completely or partly grafted on the polyester resin, and as shown above, preferably from 0.5 to 10 weight parts per 100 weight parts of all the resins is contained in the resin as the amount of the polymerizable surfactant. However, in radical polymerization systems, it is substantially difficult from the reaction principle to incorporate all the polymerizable surfactant in graft reaction, and there occurs a case where some part is not grafted and exists as a mixture. Accordingly, it is not necessary in the invention that all the polymerizable surfactant used is incorporated as graft chains, and it is sufficient for the total of both of the surfactant incorporated in the resin as the graft chains and the surfactant not incorporated in the resin and existing as a mixture to be in the above range.

<Other Vinyl Monomers>

Further, as the monomer units of the side chains, monomer units derived from radically polymerizable vinyl monomers other than the monomer units having a residue of surfactant (other vinyl monomers) can be contained in the invention. The total content of polymerizable surfactant and other vinyl monomer is preferably about from 5 to 50 weight parts per 100 weight parts of all the resins, more preferably about from 8 to 40 weight parts, and still more preferably about from 10 to 30 weight parts. In particular, in the manufacturing processes of the toner by chemical manufacturing method, it becomes possible to greatly reduce manufacturing energy by containing the mixture of 50 weight parts or less of vinyl monomers as above.

The vinyl monomers means monomers having unsaturated bonds as described above.

As other radically polymerizable vinyl monomers, aromatic vinyl monomers, (meth)acrylate monomers, vinyl ester monomers, vinyl ether monomers, monoolefin monomers, diolefin monomers, and halogenated olefin monomers can be exemplified.

As the aromatic vinyl monomers, styrene monomers, e.g., styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, etc., and derivatives of these styrene monomers are exemplified. As the (meth)acrylate monomers, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, diethylaminoethyl methacrylate, etc., are exemplified. As the vinyl ester monomers, vinyl acetate, vinyl propionate, vinyl benzoate, etc., are exemplified. As the vinyl ether monomers, vinyl methyl ether, vinyl ethyl ether, vinyl isobutyl ether, vinyl phenyl ether, etc., are exemplified. As the monoolefin monomers, ethylene, propylene, isobutylene, 1-butene, 1-pentene, 4-methyl-1-pentene, etc., are exemplified. As the diolefin monomers, butadiene, isoprene, chloroprene, etc., are exemplified. As the halogenated olefin monomers, vinyl chloride, vinylidene chloride, vinyl bromide, etc., are exemplified, but other radically polymerizable vinyl monomers are not restricted to these compounds. These monomers may be used alone, or two or more kinds of monomers may be used in combination. Polymerized products can be obtained by the addition of optional polymerization initiators generally used in the polymerization of these monomers, e.g., peroxides, persulfides, azo compounds and the like, and by performing polymerization according to well-known polymerization methods such as block polymerization, solution polymerization, emulsion polymerization, mini-emulsion polymerization, suspension polymerization, and dispersion polymerization methods.

In the selection of the vinyl monomers according to an aspect of the invention, considering the application to electrophotography, styrene and derivatives of styrene may be used as the main component of other vinyl monomers from the points of charging characteristics and image quality characteristics.

Polyester resins constituting the main chain are described below. Incidentally, in the invention, polyester resin of the main chain is more preferably a non-crystalline polyester resin.

<Polyester Resins>

Polyester resins for use in the invention are manufactured by polycondensation reaction with a polyester-forming composition including polyvalent carboxylic acid (derivative) and polyhydric alcohol (derivative) as the raw material. Polycondensation catalysts may be used to accelerate polycondensation.

The examples of the polyvalent carboxylic acid derivatives include alkyl esters, acid anhydrides and acid chlorides of polyvalent carboxylic acids, and the examples of the polyhydric alcohol derivatives include ester compounds of polyhydric alcohols and hydroxycarboxylic acids.

Polyvalent carboxylic acids for use in the invention are compounds having two or more carboxyl groups in one molecule. Of these compounds, divalent carboxylic acids are compounds having two carboxyl groups in one molecule, and, for example, oxalic acid, succinic acid, maleic acid, adipic acid, β-methyl-adipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl-acetic acid, p-phenylenediacetic acid, m-phenylene-diglycollic acid, p-phenylenediglycollic acid, o-phenylene-diglycollic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, dodecenyl-succinic acid, etc., can be exemplified. As polyvalent carboxylic acids other than divalent carboxylic acids, e.g., trimellitic acid, pyromellitic acid, naphthalenetricarboxylic acid, naphthalenetetracarboxylic acid, pyrenetricarboxylic acid, pyrenetetracarboxylic acid, etc., can be exemplified.

Polyhydric alcohols are compounds having two or more hydroxyl groups in one molecule. Of these compounds, dihydric polyol is a compound having two hydroxyl groups in one molecule and, for example, ethylene glycol, propylene glycol, butanediol, diethylene glycol, hexanediol, cyclohexanediol, octanediol, decanediol, dodecanediol, ethylene oxide adducts of bisphenol A, propylene oxide adducts of bisphenol A, etc., can be exemplified. As polyols other than dihydric polyols, e.g., glycerol, pentaerythritol, hexamethylolmelamine, hexaethylolmelamine, tetramethylolbenzoguanamine, tetraethylolbenzoguanamine, etc., can be exemplified.

Polyester structures can be arbitrarily controlled to a non-crystalline resin structure, a crystalline resin structure, or a mixed structure of these structures by the combination of these condensation polymerizable monomers. In the invention, it is possible to use one or two or more kinds of polyesters in the polyester resins, and combinations of polyester structures such as non-crystalline and crystalline can be optionally selected.

As polyvalent carboxylic acids to be used to obtain a crystalline polyester structure, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, acid anhydrides of these acids, and acid chlorides of these acids are exemplified. As polyhydric alcohol components, ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexanedimethanol, dipropylene glycol, polyethylene glycol, polypropylene glycol, etc., can also be exemplified.

As the polyvalent carboxylic acids for use to obtain non-crystalline polyesters in the invention, of the above polyvalent carboxylic acids, as dicarboxylic acids, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycollic acid, p-phenylenediglycollic acid, o-phenylenediglycollic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid can be exemplified. Further, as polyvalent carboxylic acids other than dicarboxylic acids, e.g., trimellitic acid, pyromellitic acid, naphthalenetricarboxylic acid, naphthalenetetracarboxylic acid, pyrenetricarboxylic acid, pyrenetetracarboxylic acid, etc., can be exemplified. The carboxyl groups of these carboxylic acids may be derived to acid anhydride, acid chloride or ester. Of these carboxylic acids, terephthalic acids and lower esters thereof, diphenylacetic acids, and cyclohexanedicarboxylic acids are preferably used. Incidentally, lower esters are esters of aliphatic alcohols having from 1 to 8 carbon atoms.

As the polyols for use to obtain non-crystalline polyesters in the invention, of the above polyols, polytetramethylene glycol, bisphenol A, bisphenol Z, hydrogenated bisphenol A, cyclohexanedimethanol, and alkylene oxide adducts of these polyols are preferably used. As the alkylene oxides, ethylene oxide and propylene oxide are exemplified.

Incidentally, in the invention, it is necessary that polyester resins be graft polymerizable with at least vinyl monomers containing polymerizable surfactants. Accordingly, as described above, condensation polymerizable monomers are selected to be capable of introducing an ethylenic unsaturated bond and a bisphenol A structure into the resins.

As polyvalent carboxylic acids capable of introducing an ethylenic unsaturated bond, maleic acid and fumaric acid may be used.

As the polyester resins for use in the toner according to an aspect of the invention, when the polyester resins are crystalline, the crystalline melting temperature Tm of the resins is preferably in the range of from 50 to 120° C., and more preferably from 55 to 90° C. When Tm is 50° C. or more, preferred flocculation force of crystalline resins can be obtained in a high temperature region, a good separating property can be obtained in fixation, and, further, offset does not occur. Further, when Tm is 120° C. or less, sufficient melting can be obtained and a preferred minimum fixing temperature can be ensured.

On the other hand, when the polyester resins are non-crystalline, the glass transition temperature Tg of the resins is preferably about from 40 to 80° C., and more preferably about from 50 to 65° C. When Tg is 40° C. or more, the flocculation force of the resins themselves in a high temperature region becomes proper and not accompanied by offset in fixation. Further, when Tg is 80° C. or less, sufficient melting can be obtained and a preferred minimum fixing temperature can be assured.

In the measurement of the melting temperature of a crystalline resin, a differential scanning calorimeter (DSC) is used. The melting temperature can be found as the melting peak temperature in the measurement of input compensation differential scanning calorimetry shown in JIS K-7121 in performing measurements from room temperature to 150° C. by a temperature rising rate of 10° C. per minute. There are cases where crystalline resins show a plurality of melting peaks, and the maximum peak is regarded as melting temperature in the invention.

The glass transition temperature of non-crystalline resins is a value obtained by measurement in conformity with the method provided in ASTM D3418-82 (a DSC method).

"Crystallizability" shown in the above "crystalline polyester resins" shows to have a clear endothermic peak not stepwise endothermic variation in differential scanning calorimetry (DSC), and specifically means that the half value width of the endothermic peak measured at a temperature rising rate of 10° C. per minute is not higher than 10° C.

On the other hand, resins having the half value width of endothermic peak of 10° C. or higher and resins not having a clear endothermic peak mean to be non-crystalline (amorphous).

Further, the weight average molecular weight of polyester resins to be used is preferably in the range of about from 1,500 to 60,000, and more preferably about from 3,000 to 40,000.

When the weight average molecular weight is not lower than 1,500, preferred flocculation force can be obtained as the binder resin, and a preferred hot offset property can be obtained. While when the weight average molecular weight is not higher than 60,000, a good hot offset property and a preferred minimum fixing temperature can be obtained.

Resins may be partly branched or crosslinked according to the selection of the number of carboxylic acid values of condensation polymerizable monomers and the number of alcohol values.

(Manufacturing Method of a Resin for an Electrostatic-Image-Developing Toner)

A manufacturing method of the resin for an electrostatic-image-developing toner according to an aspect of the invention includes a process of blending a polyester resin and a vinyl monomer containing at least a polymerizable surfactant (a blending process), and at least a process of polymerizing the vinyl monomer (a polymerization process).

As described above, the content of the polymerizable surfactant (the content of the monomer unit having the residue of surfactant) is preferably from 0.5 to 10 wt % in all the resin components, and as the vinyl monomer as a whole, the content is preferably from 5 to 50 wt % in all the resin components.

In the blending process, the process may be carried out under heating, and the temperature of heating can be optionally selected in the range of capable of blending the vinyl monomer and the polyester resin. Blending is preferably performed at 80 to 120° C., more preferably from 85 to 115° C., and still more preferably from 90 to 110° C. When the heating temperature is in the above range, good blending can be obtained and at the same time polymerization can be easily controlled.

In the polymerization process, polymerization may be performed in the presence of a radical polymerization initiator. The time of addition of the radical polymerization initiator is not especially restricted, but the initiator is preferably added after the blending process for the reason of easy control of radical polymerization.

The temperature of polymerization is not particularly restricted and is arbitrarily selected in the range where polymerization of vinyl monomers with each other and grafting with the polyester resin advance. The temperature of polymerization is preferably from 85 to 125° C., more preferably from 90 to 120° C., and still more preferably from 95 to 115° C.

Further, in the invention, the manufacturing method of the resin for an electrostatic-image-developing toner may further include a process of emulsifying and dispersing the vinyl monomer in an aqueous medium (an emulsification dispersion process), and a process of polymerizing the vinyl monomer (a second polymerization process), and may still further include a process of adding a vinyl monomer before the emulsification dispersion process.

The second polymerization process may be carried out in the presence of a radical polymerization initiator. The radical polymerization initiator may be added to the aqueous medium after the emulsification dispersion process and before the second polymerization process.

The emulsification dispersion process may be performed without using a solvent. In the invention, the vinyl monomer additionally added in the emulsification dispersion process is polymerized in the following second polymerization process, therefore a problem of residual monomer can be solved. Further, in the invention, since the resin to be emulsified and dispersed has side chains containing a monomer unit having the residue of a surfactant on the main chain of the polyester resin, self-dispersibility of the resin is improved, and the resin can be emulsified and dispersed in the aqueous medium with the addition of a small amount of the vinyl monomer.

(Electrostatic-Image-Developing Toner and Manufacturing Method of the Same)

The electrostatic-image-developing toner in the invention contains the resin for an electrostatic-image-developing toner according to an aspect of the invention. It is preferred to contain the resin as a binder resin.

Further, the manufacturing method of the electrostatic-image-developing toner according to an aspect of the invention includes a process of flocculating resin grains in a dispersion containing a resin grain dispersion to make flocculated grains (a flocculating process), and a process of melting the flocculated grains by heating (a melting process), wherein the resin grain dispersion contains the resin for an electrostatic-image-developing toner according to an aspect of the invention.

As described above, the manufacturing method of the resin grain dispersion includes a process of blending a polyester resin with a vinyl monomer at least having the residue of surfactant (a blending process), and a process of graft polymerizing the vinyl monomer (a first polymerization process). The manufacturing method in the invention may further include a process of additionally adding a vinyl monomer (an additional addition process), a process of emulsifying and dispersing the obtained mixture in an aqueous medium (an emulsification dispersion process), and a process of polymerizing the additionally added vinyl monomer (a second polymerization process) in this order.

As an example, after polymerization of the vinyl monomer at least having the residue of a surfactant, a vinyl monomer is further added, and after the polyester resin grafted with the monomer unit having the residue of a surfactant as the side chain is melted and dissolved at about 100° C., the resin can be emulsified in an aqueous medium by heating according to proper shear force.

In emulsification dispersion, it is also possible to optionally perform neutralization with ammonia and various amines generally used in dispersion, and various kinds of anionic and nonionic surfactants can also be added. Further, what is called auxiliary stabilizers, e.g., hexadecane, cetyl alcohol and the like can be added to suppress diffusion of the vinyl monomer in the aqueous medium (Ostwald ripening phenomenon).

In the invention, cumulative volume average grain size $D_{50v}$ of the resin grains in the resin grain dispersion obtained as described above is preferably from 80 to 500 nm, and more preferably from 150 to 300 nm. By bringing the cumulative volume average grain size into the above range, a toner having narrower grain size distribution can be manufactured.

The cumulative volume average grain size (a median diameter) can be measured with a dynamic light scattering meter (e.g., LA920, manufactured by Horiba, Ltd.).

Further, as the aqueous media that can be used in the invention, water, e.g., distilled water, ion exchange water, etc., and alcohols, e.g., ethanol, methanol, etc., are exemplified. Of these aqueous media, ethanol and water are preferred, and water such as distilled water and ion exchange water are especially preferred. These aqueous media can be used by one kind alone, or two or more media can be used in combination.

The aqueous media may contain water-miscible organic solvents. As the water-miscible organic solvents, e.g., acetone, acetic acid, etc., are exemplified.

In emulsifying the mixture of polyester resin and vinyl monomer in an aqueous medium, or after emulsification, it is necessary to complete polymerization of the vinyl monomer by the addition of at least one of an oil-soluble initiator and a water-soluble initiator that are used in general radical polymerization.

In this case, it is practicably desired to suppress volatile organic materials from the emulsified product, such as the residual monomer amount, preferably 1,000 ppm or less, more preferably 500 ppm or less, and still more preferably 200 ppm or less.

In the above emulsification dispersion, it is possible to use the techniques of what is called mini-emulsion or micro-emulsion using known radical polymerization initiators in the invention with no restriction. It is also possible to use in combination of two or more kinds of polymerization methods, e.g., these methods with conventional emulsion polymerization and suspension polymerization methods.

In the flocculating process, since the resin grain dispersion according to an aspect of the invention is prepared in an aqueous medium, the dispersion can be used as resin grain dispersion as it is. By mixing the resin grain dispersion with colorant grain dispersion and releasing agent grain dispersion, according to necessity, and further adding a flocculating agent and causing hetero-flocculation of these grains, flocculated grains of a toner can be formed.

Further, after formation of the first flocculated grains, a dispersion of polyester resin grains or other polymer grains may be added thereto to thereby form second shell layers on the surfaces of the first grains.

In the above example, the colorant dispersion is prepared separately, but when a colorant is blended with resin grains in advance, a colorant dispersion is not necessary.

After that, the flocculated grains are heated in the melting process at a temperature of the glass transition temperature or higher or the melting temperature or higher of the polyester grains to be melted and coalesced and, if necessary, washed and dried, thereby a toner can be obtained.

As the toner forms, from an amorphous form to a spherical form are preferably used. As the flocculating agents, besides surfactants, inorganic salts and divalent or higher metal salts may be used. Metal salts are preferably used in view of the control of flocculation and in characteristics such as charging of toners.

The constituents of the toner to be used are described below.

As the colorants, carbon blacks, e.g., furnace black, channel black, acetylene black, thermal black, etc., inorganic pigments, e.g., red iron oxide, Prussian Blue, titanium oxide, etc., azo pigments, e.g., Fast Yellow, Disazo Yellow, pyrazolone red, chelate red, Brilliant Carmine, Para Brown, etc., phthalocyanine pigments, e.g., copper phthalocyanine, non-metal phthalocyanine, etc., and condensed polycyclic pigments, e.g., flavanthrone yellow, dibromoanthrone orange, perylene red, quinacridone red, dioxazine violet, etc., are exemplified. Various kinds of pigments are exemplified, e.g., Chrome Yellow, Hansa Yellow, Benzidine Yellow, Indanthrene Yellow, Quinoline Yellow, Permanent Orange GTR, Pyrazolone Orange, Vulcan Orange, Watchung Red, Permanent Red, Dupont Oil Red, Lithol Red, Rhodamine B Lake, Lake Red C, Rose Bengal, Aniline Blue, Ultramarine Blue, Chalco Oil Blue, Methylene Blue Chloride, Phthalocyanine Blue, Phthalocyanine Green, Malachite Green Oxalate, C.I. Pigment Red 48:1, C.I. Pigment Red 122, C.I. Pigment Red 57:1, C.I. Pigment Yellow 12, C.I. Pigment Yellow 97, C.I. Pigment Yellow 17, C.I. Pigment Blue 15:1, C.I. and Pigment Blue 15:3, and these pigments can be used alone, or two or more kinds may be used in combination.

As the releasing agents, natural waxes, e.g., carnauba wax, rice wax, candelilla wax, etc., synthetic or mineral and petroleum waxes, e.g., low molecular weight polypropylene, low molecular weight polyethylene, sasol wax, microcrystalline wax, Fisher-Tropsch wax, paraffin wax, montan wax, etc., and ester waxes, e.g., fatty acid ester, montanate, etc., are exemplified, but the releasing agents are not restricted thereto. These releasing agents may be used by one kind alone, or two or more kinds may be used in combination. The melting temperature of the releasing agents is preferably about 50° C. or higher in view of preservation, more preferably about 60° C. or higher. From the viewpoint of offset resistance, the melting temperature is preferably about 110° C. or lower, and more preferably about 100° C. or lower.

Besides the above, if necessary, various components, e.g., an internal additive, a charge control agent, inorganic powder (inorganic grains), and organic fine grains can be added. As the examples of the internal additives, metals, such as ferrite, magnetite, reduced iron, cobalt, nickel, manganese, etc., alloys of these metals, and magnetic substances such as the compounds containing these metals are exemplified. As the charge control agents, quaternary ammonium salt compounds, Nigrosine compounds, dyes including complexes of aluminum, iron and chromium, and triphenylmethane pigments are exemplified. The inorganic powders are mainly added for the purpose of the adjustment of viscoelasticity of toners, and all the inorganic fine grains ordinarily used as the external additive of toners, e.g., silica, alumina, titania, calcium carbonate, magnesium carbonate, calcium phosphate, cerium oxide, etc., which are described in detail below, are exemplified.

The cumulative volume average grain size (also referred to as a volume average grain size) $D_{50V}$ of the toner obtained according to the manufacturing method of an aspect of the invention is preferably about from 3.0 to 9.0 μm, more preferably about from 3.0 to 8.0 μm, and still more preferably about from 3.0 to 7.0 μm. When $D_{50V}$ is in the above range, strong adhesion and good developing properties can be obtained. Further, resolution of image is enhanced.

The volume average grain size distribution index $GSD_v$ of the obtained toner is about preferably 1.30 or less. When $GSD_v$ is 1.30 or less, good resolution is obtained, and image defects such as splashing of toners and fog are not caused.

A cumulative volume average grain size $D_{50V}$ and a volume average grain size distribution index can be measured with measuring equipments, e.g., a Coulter Counter TAII (manufactured by Nikkaki Bios) and Multisizer II (manufactured by Nikkaki Bios). The cumulative distributions of volume and number of grains are drawn from the smaller grain side to the grain size range (channel) divided based on the grain size distribution, and the grain size of accumulation of 16% is defined as volume $D_{16v}$, number $D_{16p}$, the grain size of accumulation of 50% is defined as volume $D_{50v}$, number $D_{50p}$, and the grain size of accumulation of 84% is defined as volume $D_{84v}$, number $D_{84p}$, respectively. By using these values, a volume average grain size distribution index ($GSD_c$) is computed as $(D_{84v}/D_{16v})^{1/2}$, and a number average grain size distribution index ($GSD_p$) is computed as $(D_{84p}/D_{16p})^{1/2}$.

Shape factor SF1 of the obtained toner is preferably about from 100 to 140 in the light of image forming property, and more preferably about from 110 to 135. Shape factor SF1 can be found as follows. In the first place, the optical microscopic image of a toner sprayed on a slide glass is taken in LUZEX image analyzer via a video camera. SF1 is found as to toner grains of 50 or more and the obtained values are averaged. SF1 is defined as follows.

$$SF1 = \frac{(ML)^2}{A} \times \frac{\pi}{4} \times 100$$

In the above expression, ML represents the absolute maximum length of a toner grain, and A is the projected area of a toner grain.

(Electrostatic Image Developer)

The toner obtained by the manufacturing method of the electrostatic-image-developing toner according to an aspect of the invention described above is used as an electrostatic image developer. The developer is not especially restricted except for using the electrostatic-image-developing toner, and optional composition of component can be taken according to the intended use. When the electrostatic-image-developing toner is used alone, it is prepared as a one-component system electrostatic image developer, and when used in combination with a carrier, it is prepared as a two-component system electrostatic image developer.

The carrier is not especially restricted and those known as carriers themselves are exemplified. For example, known carriers such as resin covering carriers as disclosed in JP-A-62-39879 and JP-A-56-11461 can be used.

As the specific examples of carriers, the following resin covering carriers are exemplified. That is, as the nuclide grains of these carriers, nuclide grains formed of ordinary iron powder, ferrite, and magnetite are exemplified, and the average grain size is from 30 to 200 μm or so. As covering resins of the nuclide grains, styrenes, e.g., styrene, parachlorostyrene, α-methylstyrene, etc., α-methylene fatty acid monocarboxylic acids, e.g., methyl acrylate, ethyl acrylate, n-propyl acrylate, lauryl acrylate, 2-ethylhexyl acrylate, methyl methacrylate, n-propyl methacrylate, lauryl methacrylate, 2-ethylhexyl methacrylate, etc., nitrogen-containing acrylates, e.g., dimethylaminoethyl methacrylate, etc., vinylnitriles, e.g., acrylonitrile, methacrylonitrile, etc., vinylpyridines, e.g., 2-vinylpyridine, 4-vinylpyridine, etc., vinyl ethers, e.g., vinyl methyl ether, vinyl isobutyl ether, etc., vinyl ketones, e.g., vinyl methyl ketone, vinyl ethyl ketone, vinyl isopropenyl ketone, etc., polyolefins, e.g., ethylene, propylene, etc., silicones, e.g., methyl silicone, methylphenyl silicone, etc., copolymers of fluorine-containing vinyl monomers, e.g., vinylidene fluoride, tetrafluoroethylene, hexafluoroethylene, etc., polyesters containing bisphenol or glycol, epoxy resins, polyurethane resins, polyamide resins, cellulose resins, polyether resins, etc., are exemplified. These resins may be used by one kind alone, or two or more kinds may be used in combination. The amount of these covering resins is preferably from 0.1 to 10 weight parts of the carrier, and more preferably from 0.5 to 3.0 weight parts. In the manufacture of the carriers, a heating type kneader, a heating type Henschel mixer, and a UM mixer can be used, and a heating type fluidized rolling bed and a heating type kiln can be used according to the amount of the covering resins.

The blending ratio of the electrostatic-image-developing toner and the carrier in the electrostatic image developer is not especially restricted and optionally selected according to the purpose.

The electrostatic image developer (electrostatic-image-developing toner) can be used in image-forming methods of ordinary electrostatic charge image developing systems (electrophotographic systems).

Specifically, the image-forming method according to an aspect of the invention is an image-forming method including a latent image-forming process of forming an electrostatic latent image on the surface of a latent image carrier, a developing process of developing the electrostatic latent image formed on the surface of the latent image carrier with a developer containing a toner to form a toner image, a transfer process of transferring the toner image formed on the surface of the latent image carrier to the surface of an object to be transferred, and a fixing process of fixing the toner image transferred to the surface of the object to be transferred. The image-forming method is characterized in that the electrostatic-image-developing toner according to an aspect of the invention is used as the toner, or the electrostatic image developer according to an aspect of the invention is used as the developer. The image-forming method according to an aspect of the invention may optionally have a cleaning process. Further, heating fixation may be used in the fixing process.

Each of the above processes is ordinary process in itself and is disclosed, e.g., in JP-A-56-40868 and JP-A-49-91231.

The image-forming method according to an aspect of the invention can be carried out with well-known image-forming apparatus such as copiers and facsimile equipments. The electrostatic latent image-forming process is a process of forming an electrostatic latent image on an electrostatic latent image carrier. The toner image-forming process is a process of forming a toner image by developing the electrostatic latent image with a developer layer on a developer carrier. The developer layer is not especially restricted so long as the layer contains the electrostatic image developer according to an aspect of the invention containing the electrostatic-image-developing toner according to an aspect of the invention. The transfer process is a process of transferring the toner image onto an object to be transferred. The cleaning process is a process of removing the electrostatic image developer remaining on the electrostatic latent image carrier. The image-forming method according to an aspect of the invention may preferably further include a recycling process. The recycling process is a process for transferring the electrostatic-image-developing toner collected in the cleaning process to the developer layer. The image-forming method of the exemplary embodiment including the recycling process can be carried out according to image-forming apparatus of the type of a toner-recycling system, such as copiers and facsimile equipments. Further, the image-forming method can also be applied to a system of an exemplary embodiment of collecting the toner simultaneously with development by omitting the cleaning process.

(Image-Forming Apparatus)

The image-forming apparatus according to an aspect of the invention includes an electrostatic latent image carrier, a charging unit for charging the surface of the electrostatic latent image carrier, an exposure unit for forming an electrostatic latent image on the surface of the electrostatic latent image carrier charged with the charging unit by exposure in response to image information, a developing unit for forming a toner image by developing the electrostatic latent image with a developer containing a toner, and a transfer unit for transferring the toner image from the carrier to a material to be recorded, and, if necessary, a fixing unit for fixing the toner image on a base material for fixation. In the transfer unit, transfer may be carried out two or more times by using intermediate transfer media.

The constitutions of the electrostatic latent image carrier and each unit described in each process of the above image-forming method are preferably used.

As each unit described above, various units known in image-forming apparatus can be used. The image-forming apparatus for use in the invention may include units and equipments having the constitutions other than those described above. In the image-forming apparatus in the invention, two or more units described above may be used at the same time.

The invention will be described in detail with reference to examples, but the invention should not be construed as being restricted thereto.

The electrostatic-image-developing toners in the examples are prepared as follows: Each of a resin grain dispersion, a colorant grain dispersion and a releasing agent grain dispersion is prepared, a polymer of metal salt is added to the above dispersions while mixing and stirring the dispersions in a prescribed proportion, and the mixture is neutralized in the ionic property to form flocculated grains.

In the next place, inorganic hydroxide is added to the reaction system to adjust the pH in the system from weak acid to neutral, and then the flocculated grains are heated at a temperature not lower than the glass transition temperature or not lower than the melting temperature of the resin grains, thereby the resin grains are melted and coalesced.

After termination of reaction, a desired toner is obtained through sufficient washing, solid-liquid separation, and drying. Each preparation method and the measuring method of each characteristic value are described below.

<Measurement of Melting Temperature and Glass Transition Temperature>

In accordance with a differential scanning calorimetric method (DSC), with "DSC-20" (manufactured by Seiko Instruments Inc.), 10 mg of a sample is heated at a temperature of a constant raising rate (10° C./min), and a melting temperature and a glass transition temperature are found from the base line and the endothermic peak.

<Measurement of Weight Average Molecular Weight Mw and Number Average Molecular Weight Mn>

The values of weight average molecular weight Mw and number average molecular weight Mn are measured by gel permeation chromatography (GPC) on the following condition. A solvent (tetrahydrofuran) is flown at a flow rate of 1.2 ml/min at 40° C., and 3 mg of a tetrahydrofuran sample solution having concentration of 0.2 g/20 ml is poured as the sample weight and measurement is performed. Further, in measuring the molecular weight of the sample, measuring condition is selected such that the molecular weight of the sample is included in the range where the logarithms of the molecular weights of calibration curves made by several kinds of monodispersed polystyrene standard samples and the count numbers make a straight line.

Incidentally, the reliability of the result of measurement can be confirmed by the fact that NBS706 polystyrene standard sample on the above measuring condition shows the following values.

Weight average molecular weight Mw: $28.8\times10^4$

Number average molecular weight Mn: $13.7\times10^4$

As the columns of GPC, TSK-GEL, GMH (manufactured by TOSO CORPORATION) are used.

The solvent and measuring temperature are optionally changed according to the measuring sample.

When a resin grain dispersion is manufactured by using aliphatic polyester as the polyester and a monomer containing aromatic group as the addition polymerizable resin and the molecular weights of both resins are analyzed by GPC, respective molecular weights can be analyzed with a detector attached with an apparatus separating UV and RI.

<Polymerization of Polyester Resin 1>

| | |
|---|---|
| 1,4-Cyclohexanedicarboxylic acid | 77.9 weight parts |
| Phthalic acid anhydride | 270.5 weight parts |
| 2 Mols of ethylene oxide adduct of bisphenol A | 708.7 weight parts |
| Maleic acid anhydride | 25.4 weight parts |
| Dodecylbenzenesulfonic acid | 6.0 weight parts |

The above materials are blended and placed in a stainless steel reactor equipped with a stirrer, and subjected to polycondensation reaction under reduced pressure (20 kPa) at 130° C. for 5 hours. After 5 hours of the polymerization, the reaction system is further subjected to polycondensation for 20 hours by raising the temperature to 145° C. and at the degree of pressure reduction of 5.0 kPa or less to obtain homogeneous and transparent amorphous polyester resin 1. The weight average molecular weight of polyester resin 1 by GPC is 12,000, and the glass transition temperature (onset) is 55° C. The acid value of the polymer composition (polyester resin 1) dissolved in THF and measured with an ethanol solution of potassium hydroxide is 14.5 mg KOH/g.

<Polymerization of Polyester Resin 2>

| | |
|---|---|
| 1,4-Cyclohexanedicarboxylic acid | 77.9 weight parts |
| Phthalic acid anhydride | 299.0 weight parts |
| 2 Mols of ethylene oxide adduct of bisphenol A | 708.7 weight parts |
| Dodecylbenzenesulfonic acid | 6.0 weight parts |

The above materials are blended and subjected to polymerization in the same manner as in polyester resin 1. The weight average molecular weight of the obtained resin is 11,500, the glass transition temperature is 57° C., and acid value is 14.0 mg KOH/g.

<Preparation of Colorant Grain Dispersion (Pigment Dispersion)>

Cyan pigment (1,000 weight parts) (Pigment Blue 15:3, manufactured by Dainichiseika Color & Chemicals Mfg. Co., Ltd.), 150 weight parts of an anionic surfactant (Neogen R, manufactured by DAI-ICHI KOGYO SEIYAKU CO., LTD.), and 9,000 weight parts of ion exchange water are blended, dissolved, and dispersed for about 1 hour with a high pressure impact disperser Altimizer (Model HJP30006, manufactured by Sugino Machine Limited) to prepare a cyan pigment dispersion (a colorant grain dispersion). The average grain size of the dispersed cyan pigment is 0.15 μm, and the colorant grain concentration is 23 wt %.

<Preparation of Releasing Agent Grain Dispersion (Ester Wax Dispersion)>

Ester wax (50 weight parts) (WE-2, melting temperature: 65° C., manufactured by Nippon Oils & Fats Co., Ltd.), 5 weight parts of an anionic surfactant (Neogen RK, manufactured by DAI-ICHI KOGYO SEIYAKU CO., LTD.), and 200 weight parts of ion exchange water are heated at 95° C., dispersed with a homogenizer (ULTRA-TURRAX T50, manufactured by IKA® Japan), and then subjected to dispersion treatment with a Manton Gaulin high pressure homogenizer (manufactured by Gaulin Co., Ltd.) to prepare an ester wax dispersion (a releasing agent grain dispersion) having an average grain size of 0.23 μm and grain concentration of 20 wt %.

Example 1

Preparation of Resin Grain Dispersion

After mixing 10 weight parts of sodium styrenesulfonate with 10 weight parts of a vinyl monomer mixture (mixing ratio: styrene (24 weight parts)/n-butyl acrylate (6 weight parts)/dodecanethiol (3 weight parts)), the mixture is added to 100 weight parts of polyester resin 1 and thoroughly stirred and blended at 100° C. After that, 0.2 weight parts of t-butyl peroxybenzoate is added thereto as an initiator, graft polymerization of the vinyl monomer on polyester resin 1 is performed at 105° C. for 3 hours to obtain resin A. The polymerization rate of the vinyl monomer after polymerization is 99.9% by weight-dry method.

Here, the rate of polymerization by weight-dry method is measured in accordance with JIS K6387-2. Specifically, all the solids content of the obtained resin is measured, and the rate of polymerization is found from the ratio of the solids content computed from the case where all the amounts of the used monomers are polymerized to the solids content measured.

Further, 1 g of the resin after polymerization is taken and refined with THF/methanol by a precipitation method, and graft of the vinyl polymer on the polyester resin is confirmed by infrared absorption spectrum IR of the resin (FTIR 8400S, manufactured by Shimadzu Corporation) and proton nucleus magnetic resonance spectrum NMR (manufactured by Varian Technologies Japan Ltd., 300 MHz). Further, dissipation of double bonding protons derived from sodium styrenesulfonate and the fact that sodium styrenesulfonate is not present as monomer are also confirmed by NMR analysis.

In the case of resin A, in graft polymerization of radically polymerizable surfactant and other vinyl monomer to the polyester resin, reaction to the unsaturated double bond derived from maleic acid contained in the polyester skeleton preferentially advances. Accordingly, when IR and NMR of polyester resin 1 before graft polymerization and refined product of resin A after polymerization are compared, attenuation of characteristic peak 1,650 $cm^{-1}$ (C═C stretching) derived from maleic acid double bond is confirmed in IR, and attenuation of proton peak added to the double bond of from 6.5 ppm to 6.3 ppm is confirmed in $^{1}H$-NMR.

Further, since sodium salt of styrenesulfonic acid is good in copolymerizability with styrene, vinyl acrylate, and dodecanethiol, it can be judged that vinyl monomer containing sodium styrenesulfonate added is graft polymerized on the unsaturated double bond in the polyester.

Further, after 10 weight parts of triethanolamine is added to resin A to neutralize the terminal carboxylic acid of the polyester resin, and 23 weight parts of the vinyl monomer mixture of styrene, n-butyl acrylate and dodecanethiol is further added and mixed by heating at 95° C., 2 weight parts of sodium dodecylbenzenesulfonate is added and the mixture is further stirred at 95° C. for 1 hour.

After lowering the temperature to 90° C., 330 weight parts of boiling water at 90° C. is dropped while stirring the resin to obtain resin grain dispersion 1. The grain size of the emulsified product on measurement with a light scattering grain size distribution measuring apparatus (LA920, manufactured by Horiba, Ltd.) is 253 nm.

To the emulsified product is further added 3 weight parts of distilled water in which 0.46 weight parts of ammonium persulfate is dissolved, and polymerization of the vinyl monomer is carried out under nitrogen current at 80° C. for 5 hours to obtain resin grain dispersion 2. The monomer polymerization rate of the obtained polymerized product by weight-dry method is 99.99%, the grain size is 190 nm, the weight average molecular weight is 14,500, Tg is 55° C., and the solid content is 31.9%.

<Preparation of Toner Grains 1: Emulsification Polymerization Flocculation Method>

Resin grain dispersion 2 (275 weight parts) obtained by polymerization of the radically polymerizable monomer, 34.4 weight parts of the above colorant grain dispersion (pigment dispersion), 33 weight parts of the releasing agent grain dispersion (ester wax dispersion), 573 weight parts of ion exchange water, and 1.8 weight parts of sodium alkyl biphenyl ether disulfonate are put in a cylindrical stainless reactor, and the mixture is mixed and dispersed with ULTRA-TURRAX while applying shear force at 8,000 rpm for 15 minutes.

Subsequently, 0.18 weight parts of a 10% nitric acid aqueous solution containing polyaluminum chloride is dropped thereto as the flocculating agent. At this time, pH of the raw material dispersion is adjusted to the range of 2.8 to 3.2 with a 0.1N sodium hydroxide aqueous solution and a 0.1N nitric acid aqueous solution.

After that, the resin grains, colorant grains and releasing agent grains are gradually flocculated by heating in a stainless steel kettle equipped with a stirrer and a thermometer while stirring the raw material dispersion, and the cumulative volume average grain size is adjusted to 6.0 μm (measured with TA-II, manufactured by Coulter Counter, aperture diameter: 50 μm). The pH of the reaction system is raised to 9.0 and the temperature is increased to 95° C. and the temperature is retained for 3 hours to obtain potato-like shaped toner grains having a cumulative volume average grain size of 5.8 μm and a volume average grain size distribution index ($GSD_v$) of 1.21. Subsequently, the obtained toner grains are cooled, sieved through a filter having a mesh size of 45 μm, sufficiently washed with water repeatedly, and then dried with a refrigerating drier to obtain toner grains 1.

The cumulative volume average grain size and volume average grain size distribution index are measured with measuring equipment of a Coulter Counter TAII (manufactured by Beckman Coulter K.K.). The cumulative distribution of the volume of grains is drawn from the smaller grain side to the grain size range (channel) divided based on the grain size distribution measured, and the grain size of accumulation of 16% is defined as volume $D_{16v}$, the grain size of accumulation of 50% is defined as volume $D_{50v}$, and the grain size of accumulation of 84% is defined as volume $D_{84v}$. By using these values, a volume average grain size distribution index ($GSD_v$) is computed as $(D_{84v}/D_{16v})^{1/2}$.

<Preparation and Evaluation of Developer 1>

One part of colloidal silica (R972, manufactured by Nippon Aerosil Co., Ltd.) is externally added to 100 parts of toner grains 1 and blended with a Henschel mixer to obtain an electrostatic-image-developing toner.

One hundred (100) parts of ferrite grains (average grain size: 50 μm, manufactured by Powder Tech Co., Ltd.) and 1 part of a methacrylate resin (manufactured by Mitsubishi Rayon Co., Ltd.) are put in a pressure kneader with 500 parts of toluene, blended at ordinary temperature for 15 minutes, the temperature is raised to 70° C. under reduced pressure to distill off the toluene, and then the reaction system is cooled and graded through a sieve having a mesh size of 105 μm to prepare a ferrite carrier (resin coated carrier). The ferrite carrier and the above electrostatic-image-developing toner are mixed to manufacture a two-component system electrostatic image developer having toner concentration of 7 wt %.

Using the electrostatic image developer, a fixing property and image quality characteristics are evaluated as follows. The results obtained are shown in Table 1 below.

—Fixing Property and Image Quality Characteristics—

A fixing property and image quality characteristics are evaluated as follows. An image is formed with modified Docu Centre Color 500CP (manufactured by Fuji Xerox Co., Ltd.), and the fixing temperature and the image quality of initial image are evaluated. As the evaluation items, regarding the fixing property, whether fixation free from offset (fixing failure) at a fixing temperature of 130° C. is possible or not is evaluated, and as to the image quality characteristics, uniformity (unevenness) in image quality by fixation at 150° C. is evaluated by visual observation, and as to the image strength, pencil strength (UNI, hardness: H, manufactured by Mitsubishi Pencil Co., Ltd.) is measured.

The criteria of evaluation of fixing property are as follows.

A: Free from offset, having sufficient fixing property and practicable with no problem.

B: Offset is slightly observed but fixation is possible.

C: Fixation is impossible due to offset and not practicable.

On the other hand, the criteria of evaluation of image quality characteristics are as follows.

A: Image strength and uniformity (unevenness) of image quality are practicable with no problem.

B: There is no problem in image strength but slight unevenness in image quality is observed.

C: Image strength and uniformity (unevenness) of image quality are both insufficient and not practicable.

The developer in Example 1 is free from generation of offset as the fixing characteristics and, as the image quality characteristics, both of image quality unevenness and image strength show good results, and excellent fixing property and image quality characteristics are reconciled (both of fixation and image quality are graded A).

Example 2

After blending 1 weight part of sodium styrenesulfonate with 7 weight parts of a vinyl monomer mixture (mixing ratio: styrene (24 weight parts)/n-butyl acrylate (6 weight parts)/dodecanethiol (3 weight parts)), the mixture is added to 100 weight parts of polyester resin 1 and thoroughly stirred and blended at 100° C. The graft polymerization and confirmation thereof are carried out in the same manner as in Example 1 hereafter.

After that, emulsification of the resin is performed in the same manner as in Example 1 except for further adding 9.5 weight parts of the vinyl monomer mixture and 275.2 weight parts of boiling water at 90° C. to obtain resin grain dispersion 3. The grain size of the emulsified product on measurement is 195 nm.

To the emulsified product is further added 3 weight parts of distilled water in which 0.2 weight parts of ammonium persulfate is dissolved, and polymerization of the vinyl monomer is further performed under nitrogen current at 80° C. for 5 hours in the same manner as in Example 1 to obtain resin grain dispersion 4. The monomer polymerization rate of the obtained polymerized product by weight-dry method is 99.99%, the grain size is 200 nm, the weight average molecular weight is 18,000, Tg is 55° C., and the solid content is 31.8%.

<Preparation of Toner Grains 2: Emulsification Polymerization Flocculation Method>

Resin grain dispersion 4 (275 weight parts) obtained by polymerization of the radically polymerizable monomer, 34.4 weight parts of the above colorant grain dispersion (pigment dispersion), 33 weight parts of the releasing agent grain dispersion (ester wax dispersion), 573 weight parts of ion exchange water, and 1.8 weight parts of sodium alkyl biphenyl ether disulfonate are put in a cylindrical stainless reactor, and the mixture is mixed and dispersed while applying shear force at 8,000 rpm for 15 minutes in the same manner as in Example 1.

Subsequently, 0.18 g of a 10% nitric acid aqueous solution containing polyaluminum chloride is dropped thereto as the flocculating agent. At this time, pH of the raw material dispersion is adjusted to the range of 2.8 to 3.2 with a 0.1N sodium hydroxide aqueous solution and a 0.1N nitric acid aqueous solution.

After that, the resin grains, colorant grains and releasing agent grains are gradually flocculated by heating in a stainless steel kettle equipped with a stirrer and a thermometer while stirring the raw material dispersion, and the volume average grain size is adjusted to 6.0 μm. The pH of the reaction system is raised to 9.0 and the temperature is increased to 95° C. and the temperature is retained for 3 hours to obtain potato-like shaped toner grains having a volume average grain size of 6.0 μm and a volume average grain size distribution index ($GSD_v$) of 1.25. Subsequently, the obtained toner grains are cooled, sieved through a filter having a mesh size of 45 μm, sufficiently washed with water repeatedly, and then dried with a refrigerating drier to obtain toner grains 2.

<Preparation and Evaluation of Developer 2>

One part of colloidal silica (R972, manufactured by Nippon Aerosil Co., Ltd.) is externally added to 100 parts of toner grains 2, and toner grains 2 are further blended with the carrier in the same manner as in Example 1 to manufacture a two-component system electrostatic image developer 2.

Using the electrostatic image developer, a fixing property and image quality characteristics are evaluated in the same manner as in Example 1.

—Fixing Property and Image Quality Characteristics—

The developer in Example 2 is free from generation of offset as the fixing characteristics and, as the image quality characteristics, both of image quality unevenness and image strength show good results, and excellent fixing property and image quality characteristics are reconciled (both of fixation and image quality are graded A).

Example 3

Graft reaction and confirmation thereof are performed in the same manner as in Example 1 except for replacing sodium styrenesulfonate with 5 weight parts of potassium styrenesulfonate. After that, emulsification of the resin is carried out in the same manner as in Example 1 except for changing the amount of the boiling water of 90° C. to 318.8 weight parts to obtain resin grain dispersion 5. The grain size of the emulsified product on measurement is 220 nm.

To the emulsified product is further added 3 weight parts of distilled water in which 0.4 weight parts of ammonium persulfate is dissolved, and polymerization of the vinyl monomer is performed under nitrogen current at 80° C. for 5 hours in the same manner as in Example 1 to obtain resin grain dispersion 6. The monomer polymerization rate of the obtained polymerized product by weight-dry method is 99.99%, the grain size is 230 nm, the weight average molecular weight is 18,000, Tg is 55° C., and the solid content is 31.9%.

<Preparation of Toner Grains 3: Emulsification Polymerization Flocculation Method>

The same procedure as in Example 1 is repeated by using 275 weight parts of resin grain dispersion 6 obtained by polymerization of the radically polymerizable monomer, 34.4 weight parts of the above colorant grain dispersion (pigment dispersion), 33 weight parts of the releasing agent grain dispersion (ester wax dispersion), and 573 weight parts of ion exchange water to obtain potato-like shaped toner grains having a volume average grain size of 5.9 μm and a volume average grain size distribution index ($GSD_v$) of 1.22. Subsequently, the obtained toner grains are cooled, sieved through a filter having a mesh size of 45 μm, sufficiently washed with water repeatedly, and then dried with a refrigerating drier to obtain toner grains 3.

<Preparation and Evaluation of Developer 3>

One part of colloidal silica (R972, manufactured by Nippon Aerosil Co., Ltd.) is externally added to 100 parts of toner grains 3, and toner grains 3 are further blended with the carrier in the same manner as in Example 1 to manufacture a two-component system electrostatic image developer 3.

Using the electrostatic image developer, a fixing property and image quality characteristics are evaluated in the same manner as in Example 1.

—Fixing Property and Image Quality Characteristics—

The developer in Example 3 is free from generation of offset as the fixing characteristics and, as the image quality characteristics, both of image quality unevenness and image strength show good results, and excellent fixing property and image quality characteristics are reconciled (both of fixation and image quality are graded A).

Example 4

Graft reaction and confirmation thereof are performed in the same manner as in Example 1 except for changing the polymerizable surfactant to be used to 0.8 weight parts of sodium alkylallylsulfosuccinate (Eleminol JS-2, manufactured by Sanyo Chemical Industries Ltd.), and the amount of the vinyl monomer mixture to 3.3 weight parts. After that, emulsification of the resin is carried out in the same manner as in Example 1 except for changing the amounts of the further added vinyl monomer mixture to 5 weight parts, and the boiling water of 90° C. to 257.3 weight parts to obtain resin grain dispersion 7. The grain size of the emulsified product on measurement is 220 nm.

To the emulsified product is further added 3 weight parts of distilled water in which 0.1 weight parts of ammonium persulfate is dissolved, and polymerization of the vinyl monomer is performed under nitrogen current at 80° C. for 5 hours in the same manner as in Example 1 to obtain resin grain dispersion 8. The monomer polymerization rate of the obtained polymerized product by weight-dry method is 99.99%, the grain size is 220 nm, the weight average molecular weight is 18,000, Tg is 55° C., and the solid content is 31.9%.

<Preparation of Toner Grains 4: Emulsification Polymerization Flocculation Method>

The same procedure as in Example 1 is repeated by using 275 weight parts of resin grain dispersion 8 obtained by polymerization of the radically polymerizable monomer, 34.4 weight parts of the above colorant grain dispersion (pigment dispersion), 33 weight parts of the releasing agent grain dispersion (ester wax dispersion), and 573 weight parts of ion exchange water to obtain potato-like shaped toner grains having a volume average grain size of 6.3 μm and a volume average grain size distribution index ($GSD_v$) of 1.24. Subsequently, the obtained toner grains are cooled, sieved through a filter having a mesh size of 45 μm, sufficiently washed with water repeatedly, and then dried with a refrigerating drier to obtain toner grains 4.

<Preparation and Evaluation of Developer 4>

One part of colloidal silica (R972, manufactured by Nippon Aerosil Co., Ltd.) is externally added to 100 parts of toner grains 4, and toner grains 4 are further blended with the carrier in the same manner as in Example 1 to manufacture a two-component system electrostatic image developer 4.

Using the electrostatic image developer, a fixing property and image quality characteristics are evaluated in the same manner as in Example 1.

—Fixing Property and Image Quality Characteristics—

The developer in Example 4 is free from generation of offset as the fixing characteristics and, as the image quality characteristics, both of image quality unevenness and image strength show good results, and excellent fixing property and image quality characteristics are reconciled (both of fixation and image quality are graded A).

Example 5

Graft reaction and confirmation thereof are performed in the same manner as in Example 1 except for changing the polymerizable surfactant to be used to 8.0 weight parts of sodium alkenylsulfosuccinate (Lamtel S-180, manufactured by Kao Corporation), and the amount of the vinyl monomer mixture to 20 weight parts. After that, emulsification of the resin is carried out in the same manner as in Example 1 except for changing the amounts of the further added vinyl monomer mixture to 46 weight parts, and the boiling water of 90° C. to 395.3 weight parts to obtain resin grain dispersion 9. The grain size of the emulsified product on measurement is 210 nm.

To the emulsified product is further added 3 weight parts of distilled water in which 0.6 weight parts of ammonium persulfate is dissolved, and polymerization of the vinyl monomer is performed under nitrogen current at 80° C. for 5 hours in the same manner as in Example 1 to obtain resin grain dispersion 10. The monomer polymerization rate of the obtained polymerized product by weight-dry method is 99.99%, the grain size is 210 nm, the weight average molecular weight is 18,000, Tg is 55° C., and the solid content is 31.9%.

<Preparation of Toner Grains 5: Emulsification Polymerization Flocculation Method>

The same procedure as in Example 1 is repeated by using 275 weight parts of resin grain dispersion 10 obtained by polymerization of the radically polymerizable monomer, 34.4 weight parts of the above colorant grain dispersion, 33 weight parts of the ester wax dispersion, and 573 weight parts of ion exchange water to obtain potato-like shaped toner grains having a volume average grain size of 5.5 μm and a volume average grain size distribution index ($GSD_v$) of 1.20. Subsequently, the obtained toner grains are cooled, sieved through a filter having a mesh size of 45 μm, sufficiently washed with water repeatedly, and then dried with a refrigerating drier to obtain toner grains 5.

<Preparation and Evaluation of Developer 5>

One part of colloidal silica (R972, manufactured by Nippon Aerosil Co., Ltd.) is externally added to 100 parts of toner grains 5, and toner grains 5 are further blended with the carrier in the same manner as in Example 1 to manufacture a two-component system electrostatic image developer 5.

Using the electrostatic image developer, a fixing property and image quality characteristics are evaluated in the same manner as in Example 1.

—Fixing Property and Image Quality Characteristics—

The developer in Example 5 is free from generation of offset as the fixing characteristics and, as the image quality characteristics, both of image quality unevenness and image strength show good results, and excellent fixing property and image quality characteristics are reconciled (both of fixation and image quality are graded A).

Example 6

Graft reaction and emulsification are performed in the same manner as in Example 1 except for changing the polymerizable surfactant to be used to 0.4 weight parts of sodium styrenesulfonate to obtain resin grain dispersion 11 having a grain size of 215 nm. Further, polymerization of the vinyl monomer is performed in the same manner as in Example 1 to obtain resin grain dispersion 12 having the polymerization rate of 99.9%, the grain size of 220 nm, the weight average molecular weight of 16,500, Tg of 55° C., and the concentration of solid content of 30.5%.

<Preparation of Toner Grains 6: Emulsification Polymerization Flocculation Method>

The same procedure as in Example 1 is repeated except for using 288 weight parts of resin grain dispersion 12 to obtain potato-like shaped toner grains 6 having a volume average grain size of 5.9 μm and a volume average grain size distribution index ($GSD_v$) of 1.25.

<Preparation and Evaluation of Developer 6>

One part of colloidal silica (R972, manufactured by Nippon Aerosil Co., Ltd.) is externally added to 100 weight parts of toner grains 6, and toner grains 6 are further blended with the carrier in the same manner as in Example 1 to manufacture a two-component system electrostatic image developer 6.

Using the electrostatic image developer, a fixing property and image quality characteristics are evaluated in the same manner as in Example 1.

—Fixing Property and Image Quality Characteristics—

Fixation is possible for the developer in Example 6, but slight offset is observed (graded B). As the image quality characteristics, there is no problem in image strength but slight image quality unevenness is observed (graded B).

Example 7

Graft reaction and emulsification are performed in the same manner as in Example 1 except for changing the polymerizable surfactant to be used to 20 weight parts of sodium styrenesulfonate to obtain resin grain dispersion 13 having a grain size of 215 nm. Further, polymerization of the vinyl monomer is performed in the same manner as in Example 1 to obtain resin grain dispersion 14 having the polymerization rate of 99.9%, the grain size of 215 nm, the weight average molecular weight of 16,000, Tg of 54° C., and the concentration of solid content of 33.2%.

<Preparation of Toner Grains 7: Emulsification Polymerization Flocculation Method>

The same procedure as in Example 1 is repeated except for using 265 weight parts of resin grain dispersion 14 to obtain potato-like shaped toner grains 7 having a volume average grain size of 6.0 μm and a volume average grain size distribution index ($GSD_v$) of 1.23.

<Preparation and Evaluation of Developer 7>

One part of colloidal silica (R972, manufactured by Nippon Aerosil Co., Ltd.) is externally added to 100 weight parts of toner grains 7, and toner grains 7 are further blended with the carrier in the same manner as in Example 1 to manufacture a two-component system electrostatic image developer 7.

Using the electrostatic image developer, a fixing property and image quality characteristics are evaluated in the same manner as in Example 1.

—Fixing Property and Image Quality Characteristics—

Fixation is possible for the developer in Example 7, but slight offset is observed (graded B). As the image quality characteristics, there is no problem in image strength but slight image quality unevenness is observed (graded B).

Example 8

Graft reaction is performed in the same manner as in Example 1 except for changing the polymerizable surfactant to be used to 0.7 weight parts of sodium styrenesulfonate, and the vinyl monomer mixture to be used to 2 weight parts. Further, emulsification is performed in the same manner as in Example 1 except for using 2.5 weight parts of the vinyl monomer mixture to obtain resin grain dispersion 15 having the grain size of 280 nm. Further, polymerization of the vinyl monomer is performed in the same manner as in Example 1 except for using 0.05 weight parts of ammonium persulfate to obtain resin grain dispersion 16 having the polymerization rate of 99.9%, the grain size of 280 nm, the weight average molecular weight of 12,900, Tg of 55° C., and the concentration of solid content of 26.1%.

<Preparation of Toner Grains 8: Emulsification Polymerization Flocculation Method>

The same procedure as in Example 1 is repeated except for using 337 weight parts of resin grain dispersion 16 to obtain potato-like shaped toner grains 8 having a volume average grain size of 6.0 μm and a volume average grain size distribution index ($GSD_v$) of 1.25.

<Preparation and Evaluation of Developer 8>

One part of colloidal silica (R972, manufactured by Nippon Aerosil Co., Ltd.) is externally added to 100 weight parts of toner grains 8, and toner grains 8 are further blended with the carrier in the same manner as in Example 1 to manufacture a two-component system electrostatic image developer 8.

Using the electrostatic image developer, a fixing property and image quality characteristics are evaluated in the same manner as in Example 1.

—Fixing Property and Image Quality Characteristics—

Fixation is possible for the developer in Example 8, but slight offset is observed (graded B). As the image quality characteristics, there is no problem in image strength but slight image quality unevenness is observed (graded B).

Example 9

Graft reaction is performed in the same manner as in Example 1 except for changing the polymerizable surfactant to be used to 15 weight parts of sodium styrenesulfonate, the vinyl monomer mixture to 40 weight parts, and using 0.5 weight parts of t-butyl peroxybenzoate. Further, emulsification is performed in the same manner as in Example 1 except for changing the amount of the vinyl monomer mixture to 100 weight parts, and the amount of the boiling water of 90° C. to 550 weight parts to obtain resin grain dispersion 17 having a grain size of 200 nm. Further, polymerization of the vinyl monomer is performed in the same manner as in Example 1 except for adding 10 ml of distilled water in which 2.0 weight parts of ammonium persulfate is dissolved to obtain resin grain dispersion 18 having the polymerization rate of 99.9%, the grain size of 200 nm, the weight average molecular weight of 19,500, Tg of 54° C., and the concentration of solid content of 32.5%.

<Preparation of Toner Grains 9: Emulsification Polymerization Flocculation Method>

The same procedure as in Example 1 is repeated except for using 270 weight parts of resin grain dispersion 18 to obtain potato-like shaped toner grains 9 having a volume average grain size of 5.8 μm and a volume average grain size distribution index ($GSD_v$) of 1.24.

<Preparation and Evaluation of Developer 9>

One part of colloidal silica (R972, manufactured by Nippon Aerosil Co., Ltd.) is externally added to 100 weight parts of toner grains 9, and toner grains 9 are further blended with the carrier in the same manner as in Example 1 to manufacture a two-component system electrostatic image developer 9.

Using the electrostatic image developer, a fixing property and image quality characteristics are evaluated in the same manner as in Example 1.

—Fixing Property and Image Quality Characteristics—

Fixation is possible for the developer in Example 9, but slight offset is observed (graded B). As the image quality characteristics, there is no problem in image strength but slight image quality unevenness is observed (graded B).

Comparative Example 1

By using polyester resin 2, without performing graft polymerization onto the polyester resin, emulsification of the resin is performed in the same manner as in Example 1 except for adding 453.7 weight parts of boiling water of 90° C. after blending 101.5 weight parts of the vinyl monomer mixture with polyester resin 2 at 90° C. to obtain resin grain dispersion 19. The grain size of the emulsified product on measurement is 290 nm.

To the emulsified product is further added 3 weight parts of distilled water in which 1.0 weight part of ammonium persulfate is dissolved, and polymerization of the vinyl monomer is further performed under nitrogen current at 80° C. for 5 hours in the same manner as in Example 1 to obtain resin grain dispersion 20. The monomer polymerization rate of the obtained polymerized product by weight-dry method is 99.99%, the grain size is 310 nm, the weight average molecular weight is 19,500, Tg is 56° C., and the solid content is 32.0%.

<Preparation of Toner Grains 10: Emulsification Polymerization Flocculation Method>

The same procedure as in Example 1 is repeated by using 275 weight parts of resin grain dispersion 20 obtained by polymerization of the radically polymerizable monomer, 34.4 weight parts of the above colorant grain dispersion (pigment dispersion), 33 weight parts of the releasing agent grain dispersion (ester wax dispersion), and 573 weight parts of ion exchange water to obtain potato-like shaped toner grains having a volume average grain size of 6.4 μm and a volume average grain size distribution index ($GSD_v$) of 1.30. Subsequently, the obtained toner grains are cooled, sieved through a filter having a mesh size of 45 μm, sufficiently washed with water repeatedly, and then dried with a refrigerating drier to obtain toner grains 10.

<Preparation and Evaluation of Developer 10>

One part of colloidal silica (R972, manufactured by Nippon Aerosil Co., Ltd.) is externally added to 100 parts of toner grains 10, and toner grains 10 are further blended with the carrier in the same manner as in Example 1 to manufacture a two-component system electrostatic image developer 10.

Using the electrostatic image developer, a fixing property and image quality characteristics are evaluated in the same manner as in Example 1.

—Fixing Property and Image Quality Characteristics—

The developer in Comparative Example 1 generates offset at 130° C. as the fixing property and, as the image quality characteristics, image quality unevenness is observed, in addition, image strength is also insufficient, so that impracticable in the fixing property and image quality characteristics (both of fixation and image quality are graded C).

TABLE 1

| | | | Ex. 1 | Ex. 2 | Ex. 3 | Ex. 4 | Ex. 5 |
|---|---|---|---|---|---|---|---|
| Composition of resin (weight parts) | Polyester resin | | 100 | 100 | 100 | 100 | 100 |
| | Polymerizable surfactant | Sodium styrenesulfonate | 10 | 1 | 0 | 0 | 0 |
| | | Potassium styrenesulfonate | 0 | 0 | 5 | 0 | 0 |
| | | Sodium alkylallylsulfosuccinate | 0 | 0 | 0 | 0.8 | 0 |
| | | Sodium alkenylsulfosuccinate | 0 | 0 | 0 | 0 | 8 |
| | Other vinyl monomers | Styrene | 24 | 12 | 24 | 6 | 48 |
| | | Butyl acrylate | 6 | 3 | 6 | 1.5 | 12 |
| | Molecular weight adjustor | Dodecanethiol | 3 | 1.5 | 3 | 0.8 | 6 |
| Dispersion of resin grains | Grain size (nm) | | 190 | 200 | 230 | 220 | 210 |
| | Weight average molecular weight | | 14,500 | 18,000 | 18,000 | 18,000 | 18,000 |
| | Tg (° C.) | | 55 | 55 | 55 | 55 | 55 |
| | Solid content (%) | | 31.9 | 31.8 | 31.9 | 31.9 | 31.9 |
| Blending amount | Polymerizable surfactants in all the resins (weight parts) | | 7.0 | 0.9 | 3.6 | 0.7 | 4.6 |
| | Vinyl monomer in all the resins (weight parts) | | 28.0 | 13.6 | 25.4 | 7.6 | 39.1 |
| Characteristics of toner | Volume average grain size (μm) | | 5.8 | 6.0 | 5.9 | 6.3 | 5.5 |
| | GSDv | | 1.21 | 1.25 | 1.22 | 1.24 | 1.20 |
| Characteristics of developer | Fixing characteristic (130° C.) | | A | A | A | A | A |
| | Image quality characteristic (150° C.) | | A | A | A | A | A |

| | | | Ex. 6 | Ex. 7 | Ex. 8 | Ex. 9 | Comp. Ex. 1 |
|---|---|---|---|---|---|---|---|
| Composition of resin (weight parts) | Polyester resin | | 100 | 100 | 100 | 100 | 100 |
| | Polymerizable surfactant | Sodium styrenesulfonate | 0.4 | 20 | 0.7 | 15 | 0 |
| | | Potassium styrenesulfonate | 0 | 0 | 0 | 0 | 0 |
| | | Sodium alkylallylsulfosuccinate | 0 | 0 | 0 | 0 | 0 |
| | | Sodium alkenylsulfosuccinate | 0 | 0 | 0 | 0 | 0 |
| | Other vinyl monomers | Styrene | 24 | 24 | 3.3 | 72.7 | 73 |
| | | Butyl acrylate | 6 | 6 | 0.8 | 18.2 | 19 |
| | Molecular weight adjustor | Dodecanethiol | 3 | 3 | 0.4 | 9.1 | 9.5 |
| Dispersion of resin grains | Grain size (nm) | | 220 | 215 | 280 | 200 | 310 |
| | Weight average molecular weight | | 16,500 | 16,000 | 12,900 | 19,500 | 19,500 |
| | Tg (° C.) | | 55 | 54 | 55 | 54 | 56 |
| | Solid content (%) | | 30.5 | 33.2 | 26.1 | 32.5 | 32 |
| Blending amount | Polymerizable surfactants in all the resins (weight parts) | | 0.3 | 13.1 | 0.7 | 5.9 | 0 |
| | Vinyl monomer in all the resins (weight parts) | | 22.8 | 32.7 | 4.6 | 55.8 | 45.8 |
| Characteristics of toner | Volume average grain size (μm) | | 5.9 | 6.0 | 6.0 | 5.8 | 6.4 |
| | GSDv | | 1.25 | 1.23 | 1.25 | 1.24 | 1.30 |
| Characteristics of developer | Fixing characteristic (130° C.) | | B | B | B | B | C |
| | Image quality characteristic (150° C.) | | B | B | B | B | C |

What is claimed is:

1. A resin for an electrostatic-image-developing toner, comprising a graft polymer, wherein the graft polymer has a polyester structure in the main chain thereof;

the graft polymer comprises monomer units derived from vinyl monomers in the side chains thereof; and at least a part of the monomer units have a residue of surfactant, wherein the vinyl monomers contain a polymerizable surfactant having a salt structure, the monomer units derived from the polymerizable surfactant are contained in an amount of approximately from 0.5 to 10 wt % based on the graft polymer, and the monomer units derived from the vinyl monomers are contained in an amount of approximately from 5 to 50 wt % based on the graft polymer.

2. The resin for an electrostatic-image-developing toner according to claim 1, wherein the polymerizable surfactant comprises a sulfonate.

3. The resin for an electrostatic-image-developing toner according to claim 1, having a glass transition temperature Tg of approximately from 40 to 80° C.

4. The resin for an electrostatic-image-developing toner according to claim 1, having a weight average molecular weight of approximately from 1,500 to 60,000.

5. An electrostatic-image-developing toner comprising the resin for an electrostatic-image-developing toner according to claim 1.

6. The electrostatic-image-developing toner according to claim 5, wherein the polymerizable surfactant comprises a sulfonate.

7. The electrostatic-image-developing toner according to claim 5, having a glass transition temperature Tg of approximately from 40 to 80° C.

8. The electrostatic-image-developing toner according to claim 5, having a weight average molecular weight of approximately from 1,500 to 60,000.

9. The electrostatic-image-developing toner according to claim 5, further comprising a releasing agent.

10. The electrostatic-image-developing toner according to claim 9, wherein the releasing agent has a melting temperature of approximately from 50 to 110° C.

11. The electrostatic-image-developing toner according to claim 5, having a volume average grain size $D_{50V}$ of approximately from 3.0 to 9.0 μm.

12. The electrostatic-image-developing toner according to claim 5, having a volume average grain size distribution index $GSD_v$ of approximately 1.30 or less.

13. The electrostatic-image-developing toner according to claim 5, having a shape factor SF1 of from 100 to 140.

14. An electrostatic image developer comprising:

the electrostatic-image-developing toner according to claim 5; and a carrier.

15. A method for forming an image, comprising:

forming a latent image on a surface of a latent image carrier;

developing the formed latent image with the electrostatic image developer according to claim 14 to form a toner image;

transferring the formed toner image to a surface of an object; and fixing the transferred toner image.

16. An image-forming apparatus comprising:

a latent image carrier;

a charging unit that charges the latent image carrier;

an exposure unit that exposes the charged latent image carrier to form an electrostatic latent image on the latent image carrier;

a developing unit that develops the formed electrostatic latent image with the electrostatic image developer according to claim 14 to form a toner image; and a transfer unit that transfers the formed toner image from the latent image carrier to a material to be recorded.

17. The resin for an electrostatic-image-developing toner according to claim 1, wherein the vinyl monomers other than a polymerizable surfactant are selected from the group consisting of aromatic vinyl monomers and (meth)acrylate monomers.

18. The resin for an electrostatic-image-developing toner according to claim 1, wherein the salt structure of the polymerizable surfactant is selected from the group consisting of carboxylic acid salt, sulfonic acid salt, sulfuric acid salt, sulfuric acid ester salt, phosphoric acid salt, quaternary ammonium salt, pyridinium salt, and imidazolium salt.

19. The resin for an electrostatic-image-developing toner according to claim 18, wherein the salt structure of the polymerizable surfactant is selected from the group consisting of sulfonic acid salt, sulfuric acid ester salt, quaternary ammonium salt.

20. A resin for an electrostatic-image developing toner, which is obtained by:

mixing a polyester resin having an ethylenic unsaturated group and vinyl monomers containing a polymerizable surfactant having a salt structure, and performing graft polymerization of the vinyl monomer on the polyester resin, wherein the resin comprises a graft polymer, wherein the graft polymer has a polyester structure in the main chain thereof;

the graft polymer comprises monomer units derived from vinyl monomers in the side chains thereof; and at least a part of the monomer units have a surfactant group having a salt structure.

* * * * *